US012279676B2

(12) United States Patent
Radford

(10) Patent No.: US 12,279,676 B2
(45) Date of Patent: Apr. 22, 2025

(54) BUCKLE APPARATUS

(71) Applicant: Radford Colberg LLC, Spokane, WA (US)

(72) Inventor: David Radford, Spokane, WA (US)

(73) Assignee: Radford Colberg LLC, Spokane, WA (US)

( * ) Notice: Subject to any disclaimer, the term of this patent is extended or adjusted under 35 U.S.C. 154(b) by 47 days.

(21) Appl. No.: 17/974,788

(22) Filed: Oct. 27, 2022

(65) Prior Publication Data

US 2024/0138532 A1 May 2, 2024

(51) Int. Cl.
*A44B 11/25* (2006.01)

(52) U.S. Cl.
CPC ..... *A44B 11/2588* (2013.01)

(58) Field of Classification Search
CPC ..... A44B 11/2588; Y10T 24/2183; Y10T 24/216; A43C 11/1406; A43B 1/0054
See application file for complete search history.

(56) References Cited

U.S. PATENT DOCUMENTS 4,193,171 A 3/1980 Lichowsky
4,951,364 A * 8/1990 Marega ..... A43C 11/1406 24/70 SK
5,172,454 A 12/1992 Martignago
5,400,477 A * 3/1995 Marega ..... A43C 11/1406 24/68 SK
5,526,555 A 6/1996 Battistella et al.
5,701,639 A * 12/1997 Chen ..... A43C 11/148 24/71 SK
5,715,582 A * 2/1998 Zorzi ..... A43C 11/1433 24/71 SK
5,720,084 A * 2/1998 Chen ..... A43C 11/146 24/68 A
5,974,633 A * 11/1999 Sartor ..... A43C 11/1433 24/71 SK
6,145,168 A * 11/2000 Baggio ..... A43C 11/1466 24/71 SK
6,175,994 B1 1/2001 Nicoletti
6,324,735 B1 * 12/2001 Chen ..... A43C 11/1406 24/71 SK

OTHER PUBLICATIONS

The PCT Search Report and Written Opinion mailed Jun. 27, 2023 for PCT application No. PCT/US23/16686, 11 pgs.

* cited by examiner

*Primary Examiner* — Jason W San
*Assistant Examiner* — Louis A Mercado
(74) *Attorney, Agent, or Firm* — Lee & Hayes, P.C.

(57) ABSTRACT

A buckle includes a fixed base attachment member including a body base that has an object mounting surface, and a connection section that extends upward from the body base. A first cinch member includes a first end connected to the connection section of the fixed base attachment member, and a second end including a protrusion extending therefrom. A second cinch member includes a first end connected to the protrusion at the second end of the first cinch member, and a free end opposite the first end of the second cinch member. An adjustable attachment member is connected, at a portion between opposing ends thereof, to the first cinch member, and has an object attachment member at a first end of the opposing ends. The object attachment member is configured to attach to an object on which the object mounting surface rests when implemented on the object.

18 Claims, 17 Drawing Sheets

BUCKLE APPARATUS

BACKGROUND

Buckles of many types for many purposes are known. In general, a "buckle" consists of multiple interacting components that work together to achieve the purpose of the buckle. Usually, the purpose of a buckle is to act as a fastening or securing mechanism to hold at least one loose end of an object via a catch of varying types. In some instances, the catch is a hinged pin, a crossbar, a loop, one or more openings in structural wall of the buckle components, etc.

Furthermore, in some instances, buckles are used to tighten a secured load or an object within another object. As such, a buckle may structurally be adjustable to not only fasten or secure an object, but to be further adjustable on a smaller scale to make an object loosely held or tightly secured to, against, with, or within an object.

Buckles are frequently used with apparel and footwear, such as ski boots. Buckles are also used for many other consumer items including backpacks and other miscellaneous carrying means (e.g., purses, camera bags, suitcases, vehicle seats, tie-downs to secure objects to a surface, etc.).

Accordingly, though the focus of the instant application is directed toward a ski boot buckle, it is understood that the principles disclosed herein may be applied to a variety of products to act a securing mechanism.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Overview

Figure 1:
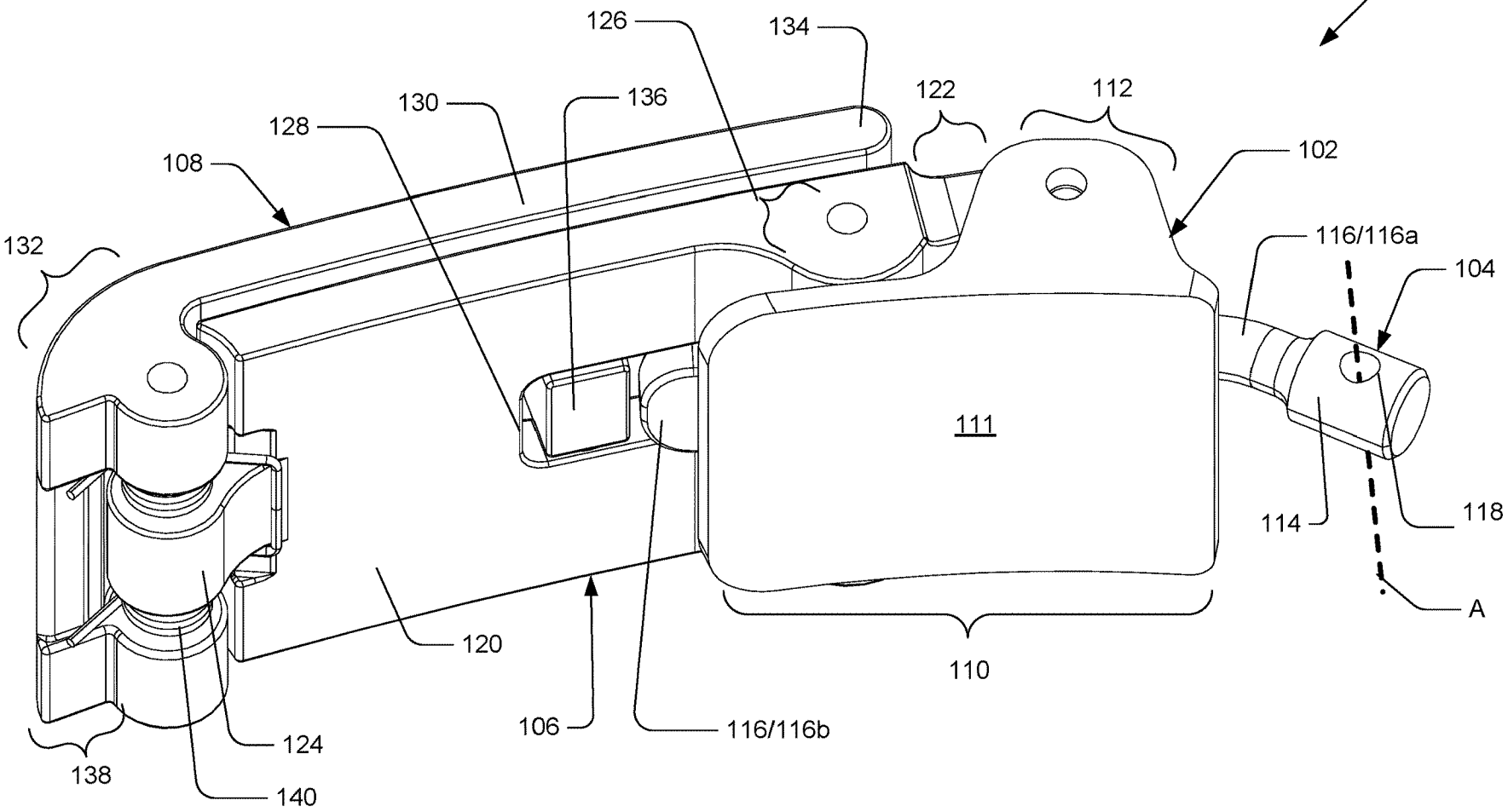
FIG. 1 illustrates a perspective view of an embodiment of a buckle, in a closed position, according to this disclosure.

This disclosure is directed to a buckle. More specifically, this disclosure depicts a buckle that may be used in many instances such as, for example, on a boot (e.g., ski boot, snowboard boot, space boot, hiking boot, snow boot, rain boot, combat boot, motocross boot, waders, etc.). The buckle as disclosed may facilitate securing and tightening one object to or within another object. An example of this includes one object being a ski boot, and thus a buckle thereon may facilitate tightly securing a person's foot (another object) within the ski boot. Nevertheless, one skilled in the art will realize that the buckle, as disclosed herein, may be applied to objects other than boots, such as tightening a load to a surface of a transport device.

In an embodiment, the buckle may include a pair of attachment members that are connected in part to a surface of an object. As indicated above, the object may vary, but for the sake of convenience and clarity in the description, the example referenced object hereinafter is a "ski boot." Thus, each of the attachment members is connected to a part of the ski boot. Additionally, a cinching mechanism is connected between the pair of attachment members to cinch (i.e., fasten tightly) the attachment members together. The cinching mechanism may include one or more components (e.g., bars, links, arms, levers, members, etc.).

In an embodiment, the cinching mechanism may be configured to be easily manually manipulable even when user is wearing gloves, which due to the thickness thereof, may interfere with the normal or usual dexterity of the user's fingers and hands. For example, the cinching mechanism component(s) may have a width and a length that is easier for gloved hands to grab. Further, the cinching mechanism may include more than one component, such as two components that are coupled together (e.g., linked, attached, connected, etc.).

Additionally, the cinching mechanism may extend outward away from the attachment members, in an open position, and then pivoted via a fixed pivot location in a first direction to a closed position, whereat the attachment members are cinched closer together. The pivot action of the cinching mechanism additionally causes the cinching mechanism to be held or rigidly fixed in place in a closed position, in which the longest dimension of the cinching mechanism extends directionally along a side of the ski boot. In general, the cinching mechanism will stay in the closed position until oppositely applied manipulation thereof overcomes the tension force holding the cinching mechanism in place. The further manipulation (e.g. pulling the cinching mechanism in a pivotal movement in a direction opposite the direction used to cinch the attachment members) causes the cinching mechanism to be in the closed position. In an embodiment with two components in the cinching mechanism, subsequent to the cinch action, the second component may be folded inward to lock in place against the first component, thereby reducing the extent (e.g., lateral length) of the footprint of the cinching mechanism.

Various embodiments of locking means with respect to the closed position of the buckle are disclosed. However, it is understood that other mechanical means of creating a locked state of the cinching mechanism are contemplated and that such are within the scope of the apparatus disclosed.

Notably, the buckle components may be conceptualized as link members in a mechanical system, and as such, terminology such as "joint," "fixed base," "crank shaft," "first link," "second link," etc., may be used to enhance understanding from the mechanical perspective to identify parts with respect to functionality of the buckle.

Illustrative Embodiments of a Buckle

Specifically, FIG. 1 depicts the perspective view of an embodiment of a buckle 100, in a closed position, primarily from a bottom and back-looking perspective. As shown, buckle 100 may include a base attachment member 102, an adjustable attachment member 104, a first cinch member 106, and a second cinch member 108. The base attachment member 102 and the adjustable attachment member 104 each contain the term "attachment members" to indicate the intended position and function involved therewith. Specifically, the base attachment member 102 and the adjustable attachment member 104 each have at least a portion thereof that is in a direct connection/contact with a separate object (e.g., boot or other object of interest) on which the buckle 100 is to be used. Likewise, the cinching members (e.g., the first cinch member 106 and the second cinch member 108) each use the term contain the term "cinch" to indicate the involvement in the cinching action of the buckle 100 to reduce the distance between the base attachment member 102 and the adjustable attachment member 104.

In an embodiment, the base attachment member 102 (e.g., fixed base, joint or connection to the object, etc.) may include a body 110 having an object mounting surface 111 on a bottom side thereof which is intended to be coupled to or rest against in a fixed manner an object on which is implemented the buckle 100 for the purpose of securing a secondary object thereto or therewithin (i.e., a leg in a boot). In an embodiment, the object mounting surface 111 may be relatively uniform in height, such that there is little to no textural aspects. Alternatively, in an embodiment not shown, the object mounting surface 111 may conform with a contoured surface of the object to which it is couple. The base attachment member 102 further includes, on a front side thereof on the body 110, a connection section 112 via which the first cinch member 106 is connected thereto. In an embodiment, the connection section 112 may have a structure of a straddle mount or other similar mount to engage the first cinch member 106 (see FIG. 2 and accompanying description hereafter). For example, the connection section 112 may be defined by one or more protrusions (e.g., arms, flanges, etc.) that extend away from the body 110 out of the plane of the extension of the body 110 so as to also extend in a direction outward from the object to which the body 110 is in abutment. The connection section 112, as shown, may connect to the first cinch member 106 via a fixed pin position such that the first cinch member 106 is pivotable, at least in part.

In an embodiment, adjustable attachment member 104 (e.g., link, second link, connecting rod, etc.) may include an object attachment portion 114 that is connected lengthwise to an extension arm 116 having an end 116*a* in connection with the object attachment portion 114, and an end 116*b* disposed opposite the end 116*a*. In an embodiment, end 116*b* may be in a first position when buckle 100 is uncinched, and in a second position, which is translationally moved and distinct from the first position, when buckle 100 is cinched. Moreover, the object attachment portion 114 may include a movable joint 118, which in an embodiment as shown in FIG. 1, may include a through hole. The movable joint 118 may function, when implemented with an object, to be attached to a portion of the object that is movable with respect to the portion of the object that is fixed to the object mounting surface 111, so that upon closing the buckle 100 to cinch buckle 100 tightly in place, the movable joint 118 may move in a lateral or radial directed movement. Further, in an embodiment, the movable joint 118 may have an axis A therethrough that defines the orientation of the through hole in movable joint 118. The direction of the axis A may be fixed or, in an embodiment not shown, may be reorientable in order to accommodate coupling the adjustable attachment member 104 in a different orientation for different coupling with the object.

Figure 2:
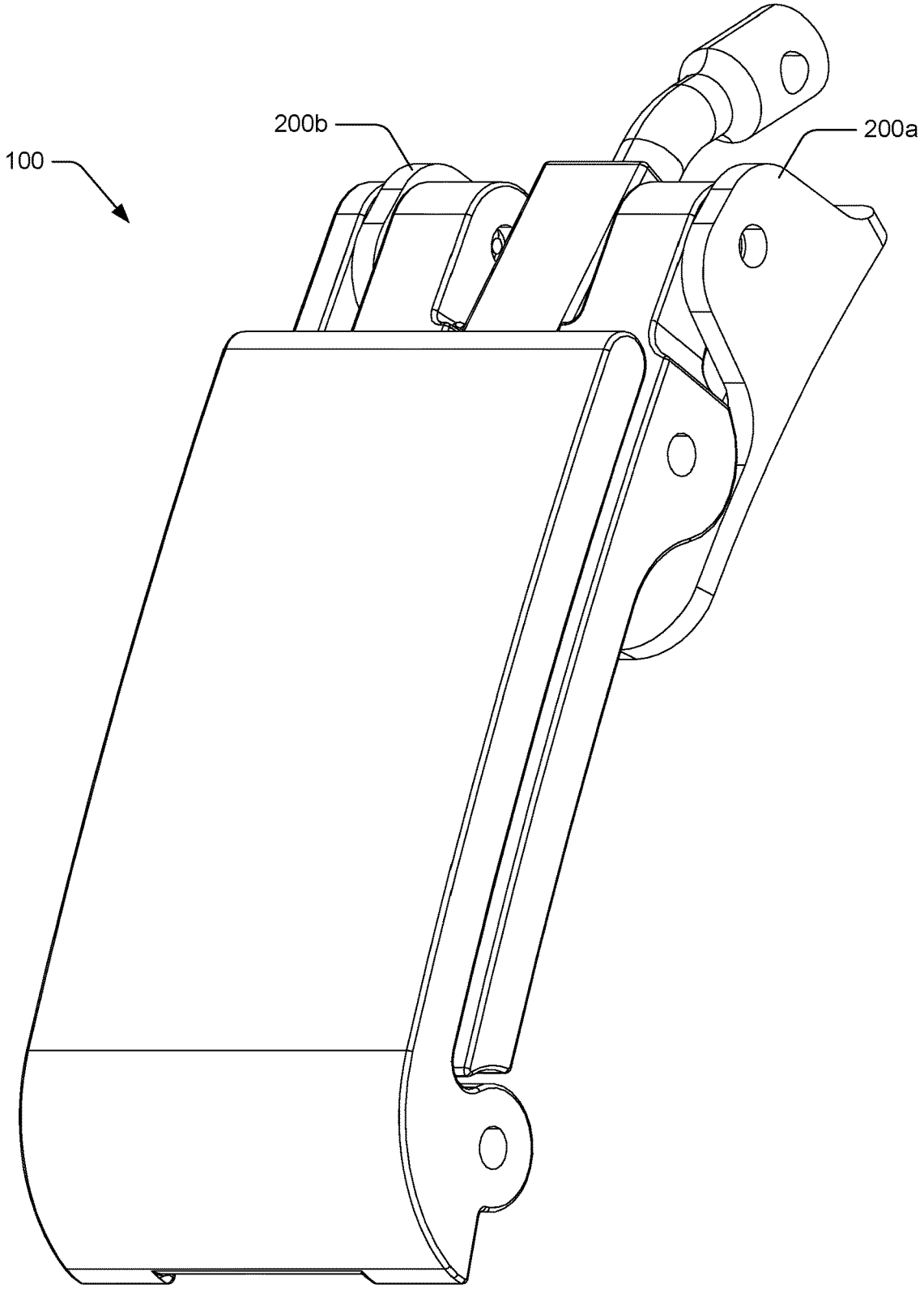
FIG. 2 illustrates another perspective view of the embodiment of FIG. 1 of the buckle, in the closed position, according to this disclosure.

In an embodiment, first cinch member 106 (e.g., link, first link, crank shaft, etc.) includes a body 120 which defines a primary shape and mass of the first cinch member 106. As depicted, in an embodiment, the body 120 may be primarily a planar elongated shape that extends between the base attachment member 102 and the second cinch member 108. The body 120 may further include, at a first end thereof, a first connection section 122 (e.g., fixed pivot joint, base attachment member joint) to attach to the base attachment member 102 at the connection section 112. The engagement between the first connection section 122 and the connection section 112 may be a fixed pivot joint or similar joint to permit rotatable hinge movement therebetween. In an embodiment, the first connection section 122 may be defined by one or more protrusions (e.g., arms, flanges, etc.) that extend away from the center of the body 120 in the plane of the extension of the body 120. For example, a pair of protrusions may extend from opposing sides of the first end of the body 120, as seen in FIG. 2. A pin or other similar fastening member (not shown) may then be inserted through aligned holes in one or more protrusions of the first connection section 122 and the connection section 112 to create the pivotable engagement therebetween.

In an embodiment, the body 120 may further include, at a second end thereof that is opposite the first end of the body 120, a second connection section 124 (e.g., second cinch member joint) to attach to the second cinch member 108. As shown, the second connection section 124 may be defined as a pivot joint that is rotationally and translationally movable. Thus, the second end of the body 120 of the first cinch member 106 may be translationally moved via a radial type of movement due to the first connection section 124 being a fixed pivot, and may further permit pivotal movement with the second cinch member 108. Accordingly, the second connection section 124 may define a first rotational and translatable pivot joint. Moreover, the movability of the first rotational and translatable pivot joint of the second connection section 124 may be achieved via a straddle mounted or cantilever mounted joint. Though structurally depicted in FIG. 1 as a single protrusion from the second end of the body 120, it is considered to be within the scope of this disclosure that the second connection section 124 may be defined by a structure or element that is more than one protrusion, flange, etc. in a way to engage a corresponding structure of the second cinch member 108.

In an embodiment, the body 120 may further include, at a mid-body portion thereof (i.e., between the first end and the second end of the body 120), a third connection section 126 (e.g., adjustable attachment member joint) at which the adjustable attachment member 104 is pivotably and translationally attached. Accordingly, the third connection section 126 may define a second rotational and translatable pivot joint. Moreover, the movability of the second rotational and translatable pivot joint of the third connection section 126 may be achieved via a partially straddle mounted or cantilever mounted joint.

In an embodiment, the body 120 may further include, also at a mid-body portion thereof (i.e., between the first end and the second end of the body 120), a catch 128 (e.g., an aperture, opening, hole, etc.) having a securing feature (described in examples hereinafter with respect to FIGS. 4, 15, and 16) via which the second cinch member 108 may be secured in the closed position. Moreover, in an embodiment not shown, the aperture of the catch may simply be replaced by a magnet to provide a magnetic catch means to secure the buckle.

In an embodiment, the second cinch member 108 (e.g., leverage link) may include a body 130, which, in the open position, is extendable away from the body 120 of the first cinch member 106, and in the closed position, is pivoted against the body 120 of the first cinch member 106, such that a shape of the body 130 conforms closely to a shape of the body 120 to minimize bulk of the buckle 100. As depicted, in an embodiment, the body 130 may be primarily a planar elongated shape that extends from the second cinch member 108. The body 130 may further include, at a first end thereof, a connection section 132 (e.g., second cinch member joint) that protrudes away from the body 130 to attach to first cinch member 106 at the second connection section 124 thereof. Thus, the pivotal engagement joint between the second cinch member 108 and the first cinch member 106 defines the second rotational and translatable pivot joint, mentioned above, of the buckle 100. Moreover, in an embodiment, the body 130 of the second cinch member 108 may have a forked shape (not shown) such that the body 130 is split into two longitudinally extending portions having a gap therebetween, whereby the adjustable attachment member 104 may be visible through the gap.

Though structurally depicted in FIG. 1 as a straddle-mounted set of protrusions from the first end of the body 130, it is considered to be within the scope of this disclosure that the connection section 132 may be defined by a structure or element that includes one or more than one protrusion, flange, extended arm, etc. that is positioned to engage a corresponding structure of the first cinch member 106.

In an embodiment, as depicted in FIG. 1, a flush closed position is achieved between the first cinch member 106 and the second cinch member 108 via the orientation of the connection second 132 with respect to the orientation of the second connection section 124. That is, the portion of the protrusions of the connection section 132 that engage, via a pivotable pin joint, the protrusion of the second connection section 124, protrude away from the body 130 in a direction that is transverse to the plane of the body 130 (i.e., the protrusions do not extend in a plane of the mass of the body 130). Thus, the connection section 132 may be oriented in alignment within the plane of the body 120. It is noted that some curvature may be incorporated into one or more of the bodies 110, 120, 130, and in such situations, the technical definition of a "plane" would not be appropriate or accurate in the context of the above uses. However, in such curved situations, where, for example, the bodies 120 and/or 130 are curved rather than primarily planar, it is understood that the connection section 132 may be located out of the trajectory path of the radius of curvature of the body 130 so as to engage with second connection section 124 in a location that thereby maintains the ability to have a flush closed position (i.e., where adjacent surfaces of bodies 120 and 130 are flush either in contact or near proximity).

In an embodiment, the body 130 may have a free end 134 opposite the first end at the second end thereof. The free end 134 is "free" in that there is no further connecting link or component attached thereto. Thus, a user is able to more easily grab the free end 134 and manipulate the components to cinch or un-cinch the buckle 100. The process of cinching (and in reverse, uncinching) the buckle 100 includes moving the first cinch member 106 and the second cinch member 108 from the open position to the closed position. In the first position, the first cinch member 106 and the second cinch member 108 are fully extended at the intersection therebetween (i.e., the second rotational and translatable pivot joint), such that respective planes through the bodies 120 and 130 are substantially in a same plane. Additionally, in the open position, the first cinch member 106 is pivoted at the first connection section 122 (at connection section 112 of the base attachment member 102) such that the aligned planes through the bodies 120 and 130 extend in a first direction that is radially outward from the connection section 112 of the base attachment member 102 at a first angle with respect to the object mounting surface 111.

In the closed position, the first cinch member 106 and the second cinch member 108 are folded backward via the second rotational and translatable pivot joint so that the respective planes through the bodies 120 and 130 are stacked (i.e., coplanar or otherwise extending in parallel). Further, the plane through the body 120 extends radially outward in a second direction from the first connection section 122 at a second angle with respect to the object mounting surface 111 that extends transverse to the first direction. In an embodiment, the second angle of extension may be oriented so that at least a portion of the body 120 abuts against the base attachment member 102 (e.g., parallel with the object mounting surface 111). Thus, in the closed position, the adjacent surfaces of the first cinch member 106 and the second cinch member 108 are flush and the free end 134 is disposed adjacent to the first end of the first cinch member 106.

Moreover, in the closed position, a catch engagement component 136 (e.g., a protrusion, latch, hook other structural feature, a magnet etc.) located on the second cinch member 108 may engage with the catch 128 of the first cinch member 106 to thereby hold the buckle 100 in the closed, cinched position. As depicted in FIG. 1, the catch engagement component 136 may be a cuboidal or other geometrical shape that is insertable through the aperture (i.e., the catch 128) of the first cinch member 106. The corresponding catch features may be secured via a compression fit, a magnetic attraction, or other means (described hereinafter).

Furthermore, in an embodiment, the second cinch member 108 may include a structural feature that prevents excessive rotation between the second cinch member 108 and the first cinch member 106 about the second rotational and translatable pivot joint. Such a structural feature may include stop member 138, which may be defined by an extended flared end on the first end of the second cinch member 108. The stop member 138 may be located adjacent the connection section 132 and extend to catch upon the body 120 of the first cinch member 106 during a pivot at the second rotational and translatable pivot joint, thereby maintaining the body 120 in line with the body 130 and preventing further pivoting. This feature may facilitate the user in the cinching and uncinching process to provide a larger handle and greater leverage to cinch the buckle tightly, while providing a way to subsequently reduce the risk of accidentally uncinching the buckle due to the folding and securing in the folded position of the second cinch member 108.

In an embodiment, buckle 100 may also include a bias component 140 (e.g., a spring clip, a biased wire, a spring, etc.) positioned at the second rotational and translatable pivot joint. The bias component 140 may be positioned between the first cinch member 106 and the second cinch member 108 to cause a biasing force to open the second cinch member 108 in the alignment with the first cinch member 106 upon release of the catch 138 from the catch engagement component 136.

In an embodiment, the various joints (e.g., "connection sections" of the respective components) are oriented such that the respective axes therethrough are linearly parallel. Additionally, the buckle 100 may be made of any suitable material for the intended use. Materials that have relatively strong tension and resiliency properties are considered for use here, including: metal, plastic, ceramic, composites, etc.

Notably, one possible advantage of the features of a buckle 100 as described herein is that the leverage to manipulate and tighten the buckle is improved from that associated with conventional buckles. Accordingly, the buckle 100 is easier to secure a tighter compressive state of buckling.

As indicated above, FIGS. 2-14 illustrates other views view of the embodiment of FIG. 1 of the buckle, in both the open position and the closed position. Additional features that are not as easily perceived in FIG. 1 are described hereinafter according to the figure in which the features are more easily seen. For example, as depicted in FIG. 2, in an embodiment, the connection section 112 of the base attachment member 102 may include a pair of protrusions, such as first connection flange 200*a* and second connection flange 200*b* that extend in parallel from opposing sides of the body 110, transversely to the object mounting surface 111.

Figure 3:
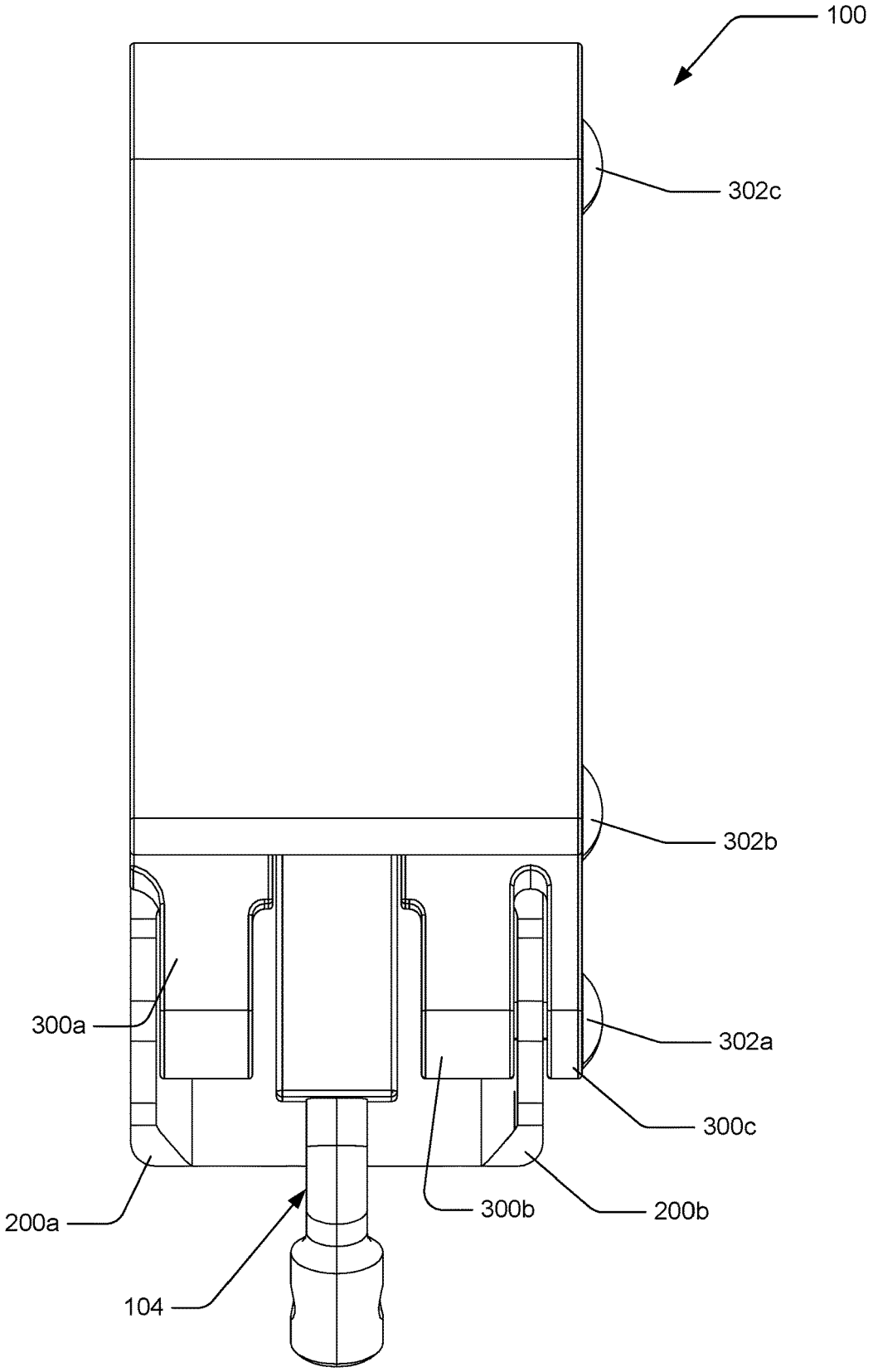
FIG. 3 illustrates a front view of the embodiment of FIG. 1 of the buckle, in the closed position, according to this disclosure.

In FIG. 3, three protrusions, representative of a first connection flange 300*a*, a second connection flange 300*b*, and a third connection flange 300*c*, which may be included in first connection section 122 of the first cinch member 106, are depicted. As shown, the first connection flange 300*a* may be joined with the first connection flange 200*a*; and the second connection flange 300*b* and the third connection flange 300*c* may be positioned in a straddle-mount around the second connection flange 200*b*. Thus, the first cinch member 106 is pivotable with the base attachment member 102. Additionally, FIG. 3 depicts heads of pins 302*a*, 302*b*, and 302*c*, which secure and create the hinge points for the respective pivot joints in the buckle 100. Notably, the adjustable attachment member 104 may pass freely through the connection section 112 of the base attachment member 102.

Figure 4:
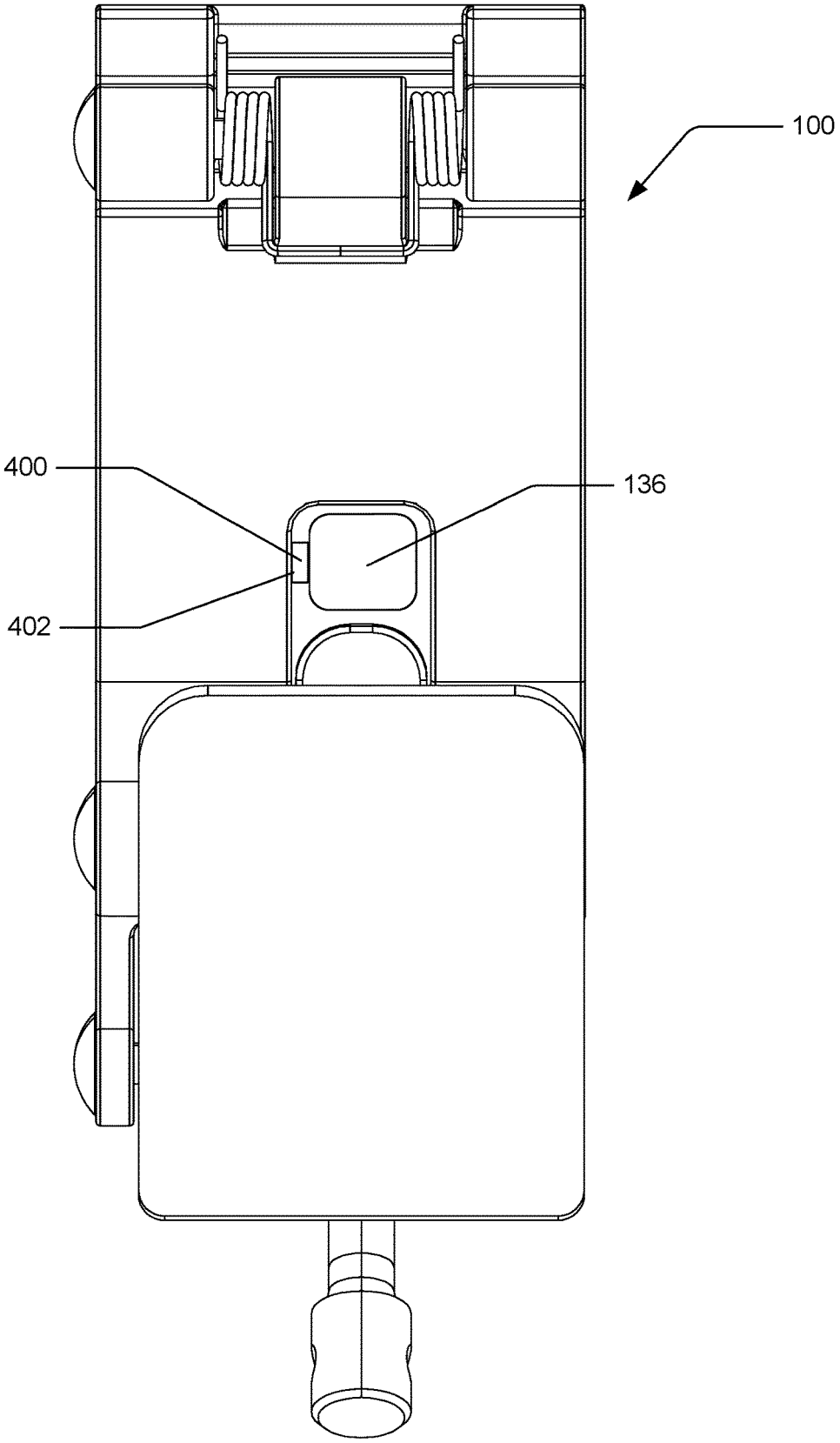
FIG. 4 illustrates a back view of the embodiment of FIG. 1 of the buckle, in the closed position, according to this disclosure.

FIG. 4 illustrates an embodiment of the catch engagement component 136 and the catch 108, embodied as a ball 400 and a detent 402, which securing means is understood by those in the industry. Inasmuch as the ball 400 and the detent 402 may be just as easily implemented on either of the two components, (e.g., referring to the sidewall of the opening of the catch 128 and the sidewall of the cuboidal block of the catch engagement component 136), the specific depiction of the ball 400 and the detent 402 on a wall is not expressly shown.

Figure 5:
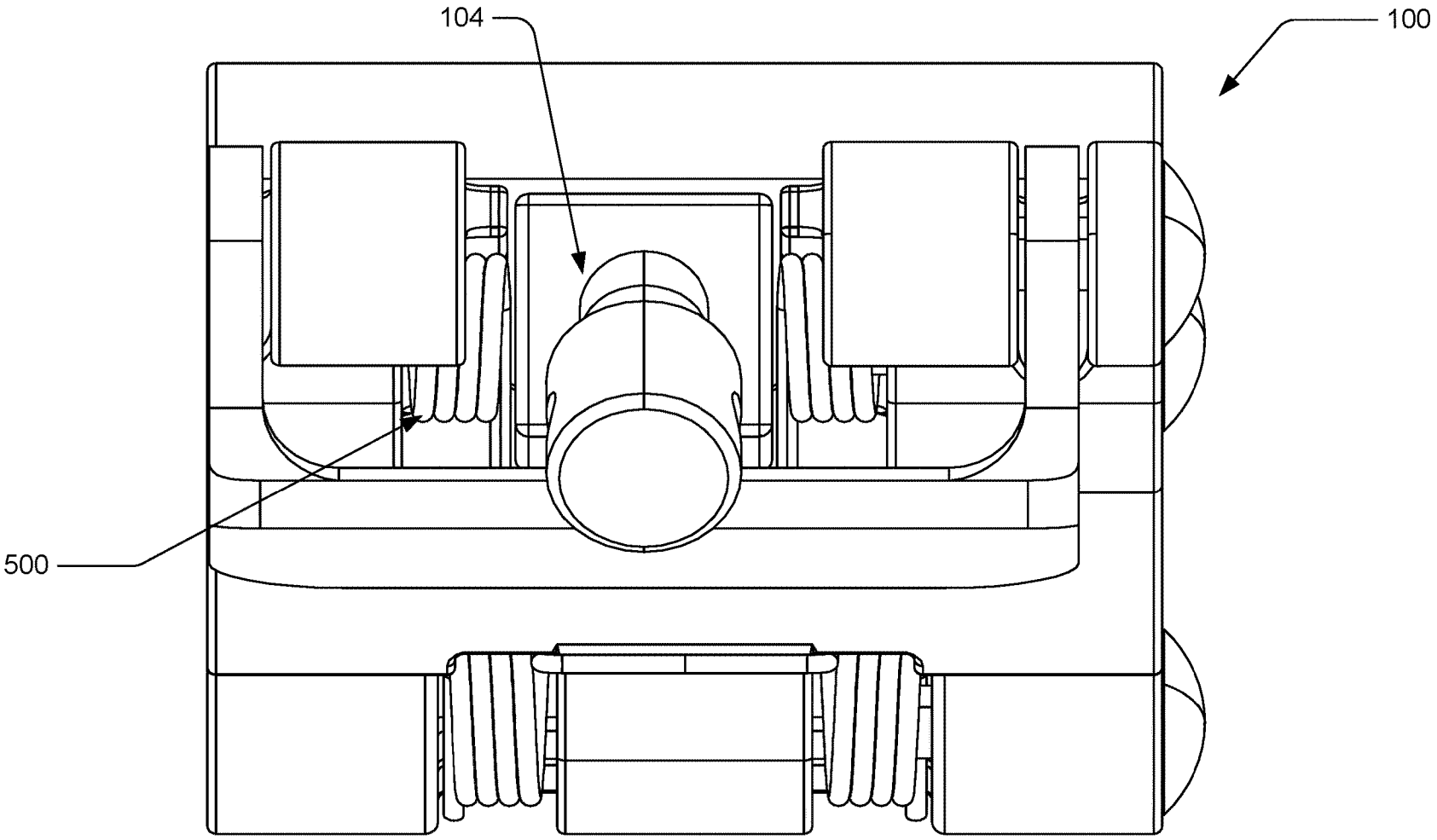
FIG. 5 illustrates a right side view of the embodiment of FIG. 1 of the buckle, in the closed position, according to this disclosure.

Like the bias component 140 in FIG. 1, FIG. 5 illustrates an embodiment of another bias component 500, positioned to bias the adjustable attachment member 104 at the first rotational and translatable pivot joint. The bias component 500 may be a spring, clip, etc. that creates a biasing force at the adjustable attachment member 104.

Figure 6:
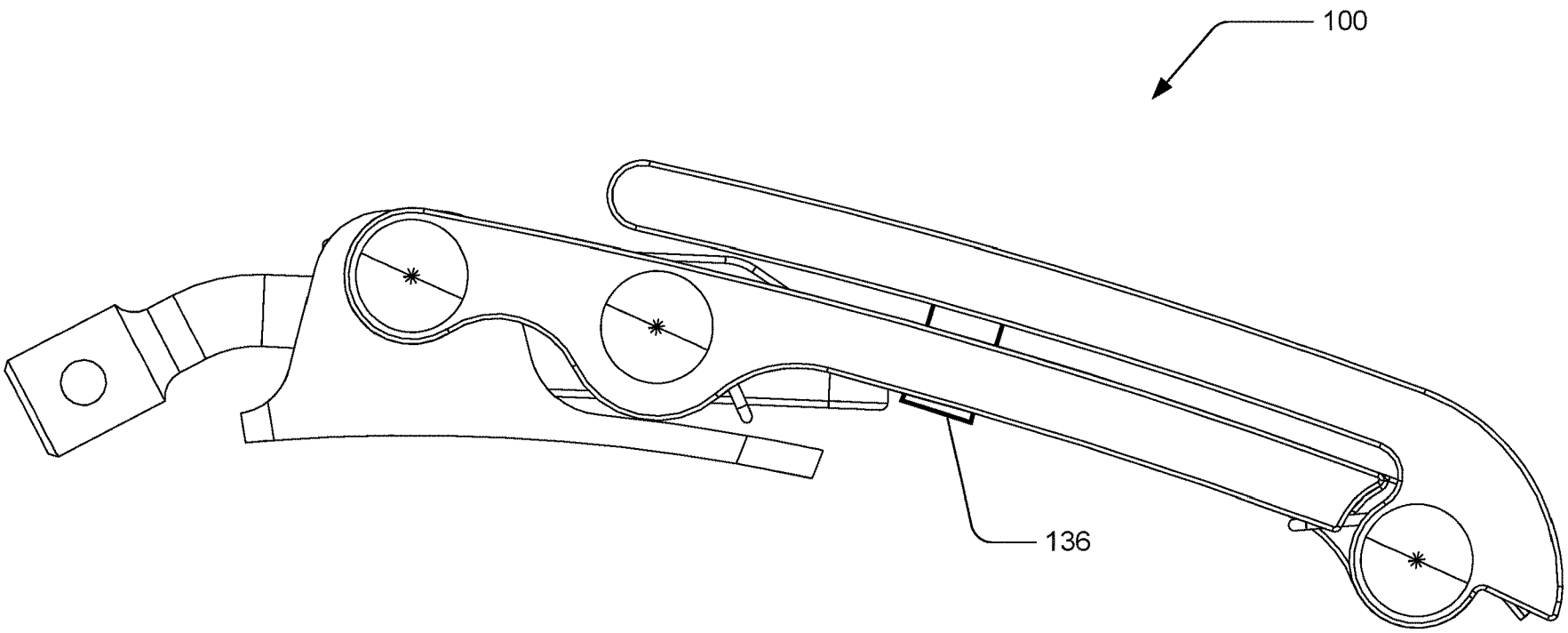
FIG. 6 illustrates a top view of the embodiment of FIG. 1 of the buckle, in the closed position, according to this disclosure.
Figure 7:
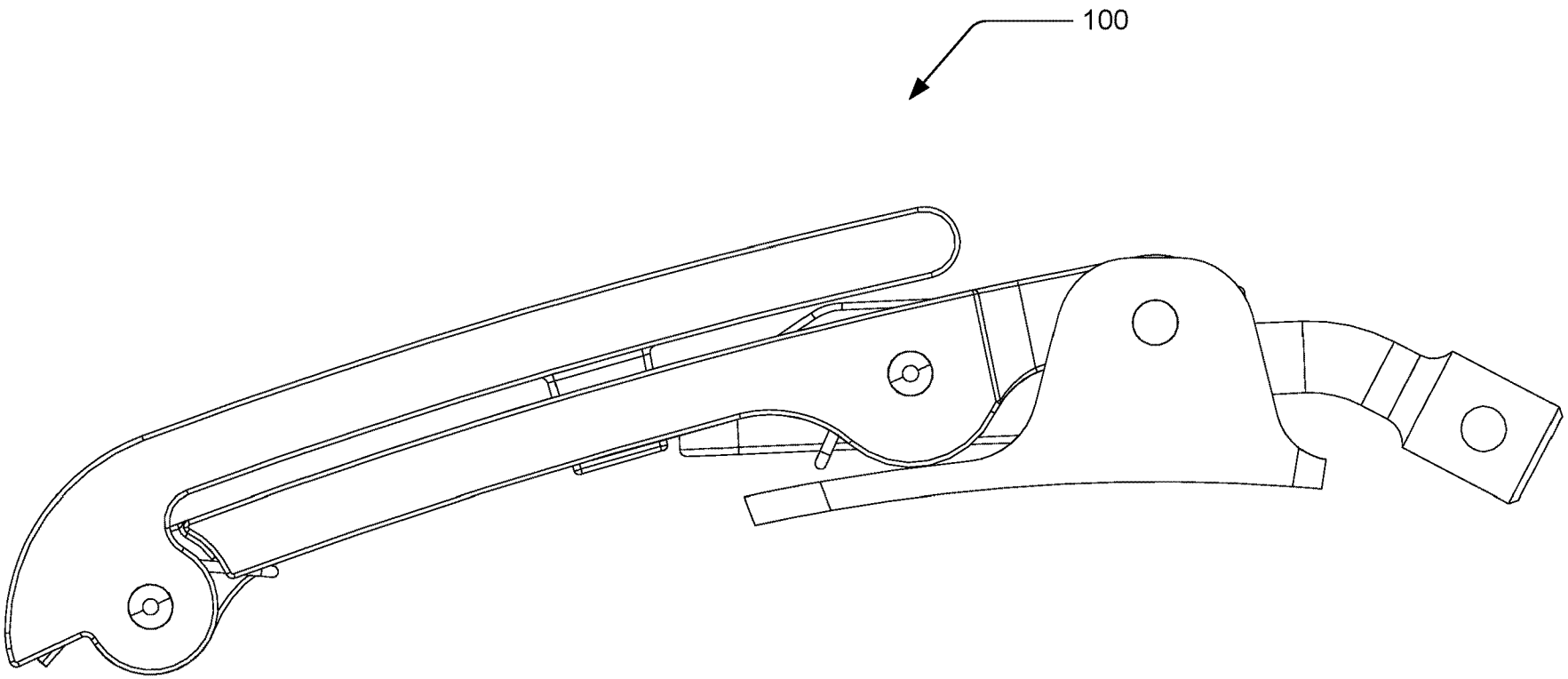
FIG. 7 illustrates a bottom view of the embodiment of FIG. 1 of the buckle, in the closed position, according to this disclosure.
Figure 8:
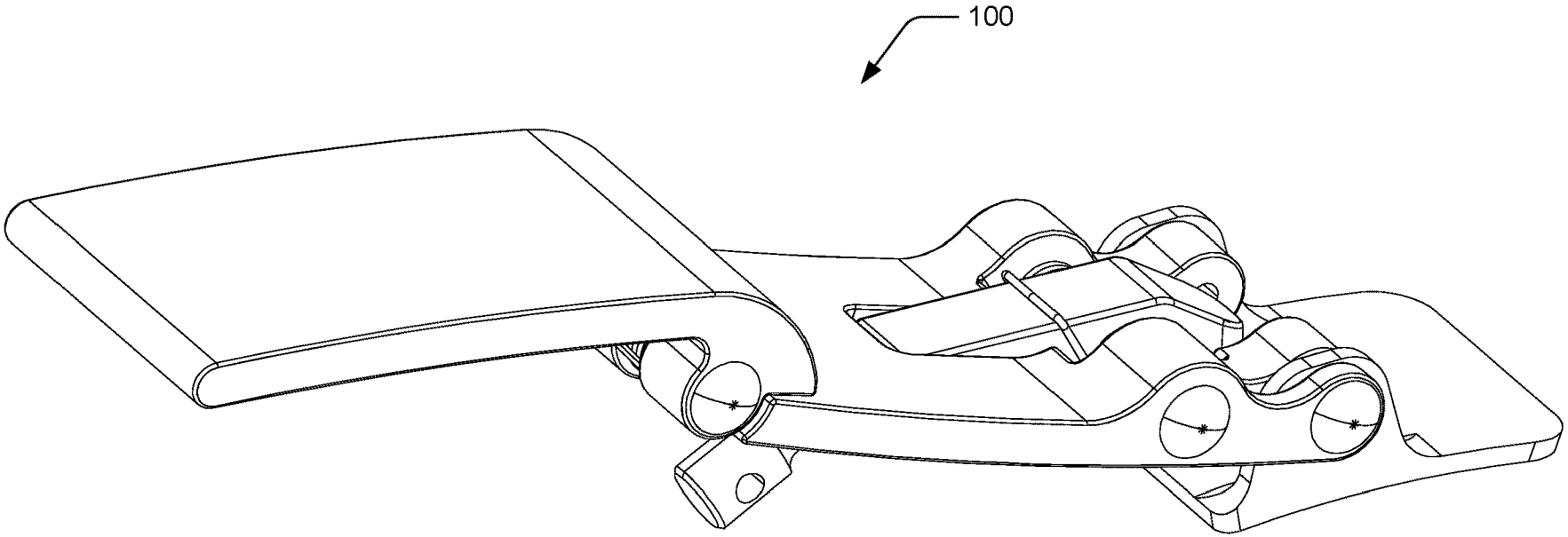
FIG. 8 illustrates a perspective view of the embodiment of FIG. 1 of the buckle, in the open position, according to this disclosure.
Figure 9:
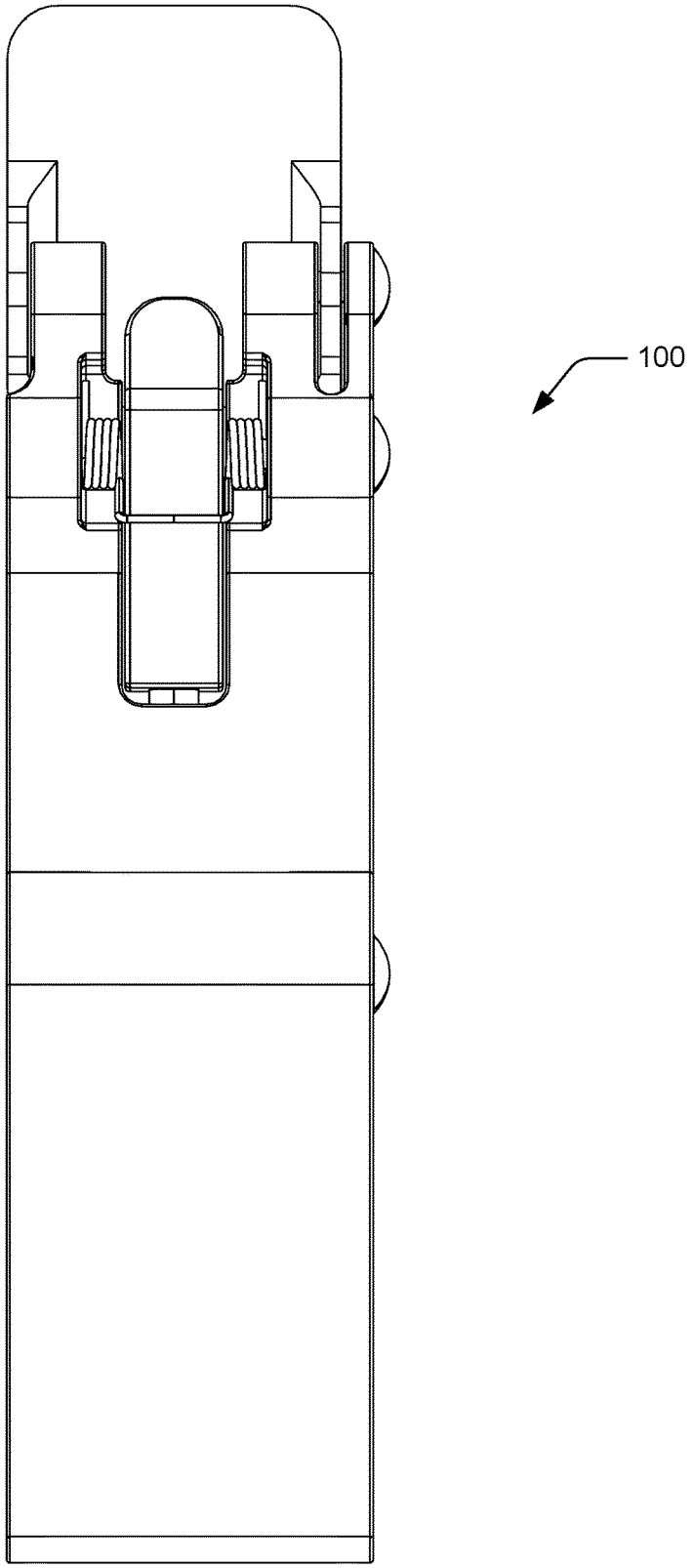
FIG. 9 illustrates a front view of the embodiment of FIG. 1 of the buckle, in the open position, according to this disclosure.
Figure 10:
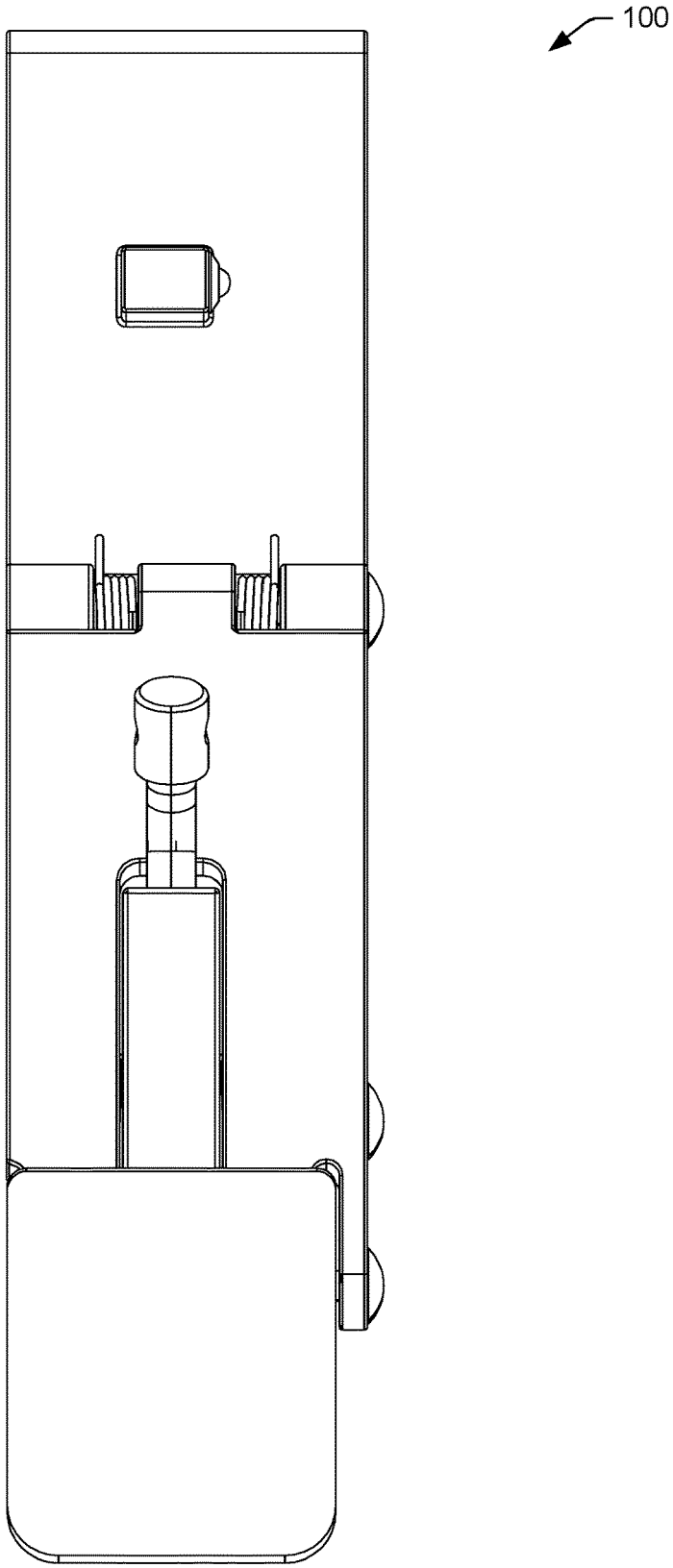
FIG. 10 illustrates a back view of the embodiment of FIG. 1 of the buckle, in the open position, according to this disclosure.
Figure 11:
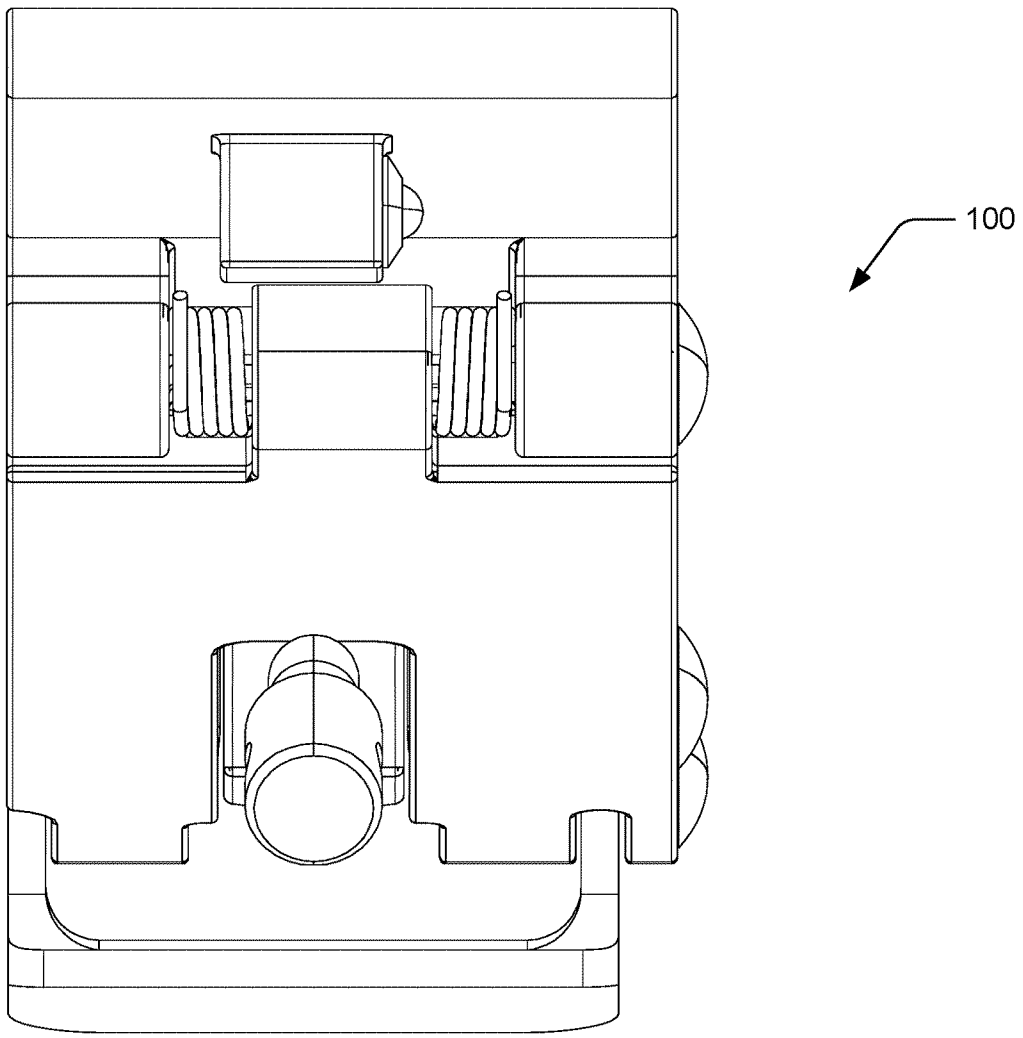
FIG. 11 illustrates a right side view of the embodiment of FIG. 1 of the buckle, in the open position, according to this disclosure.
Figure 12:
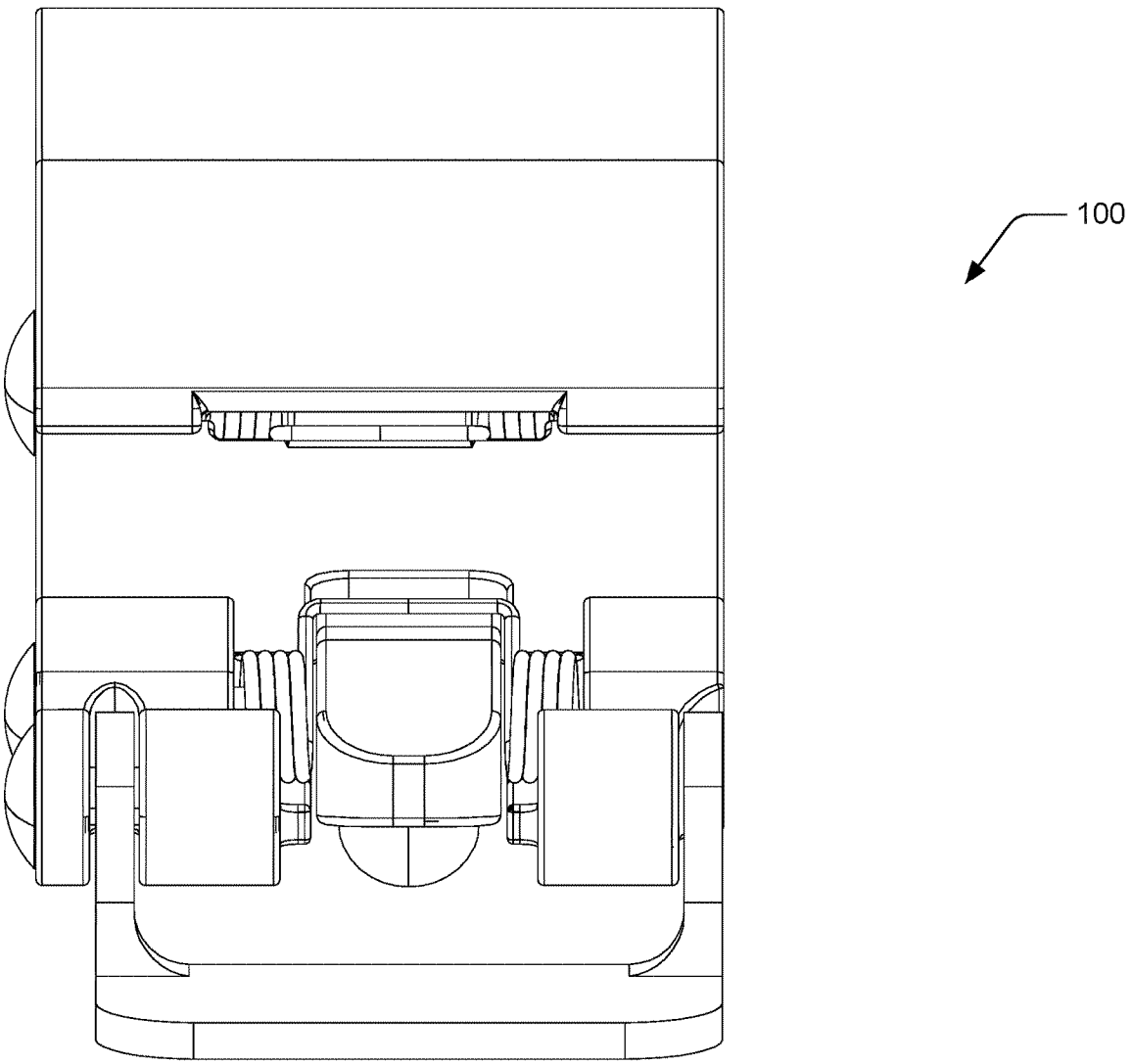
FIG. 12 illustrates a left side view of the embodiment of FIG. 1 of the buckle, in the open position, according to this disclosure.
Figure 13:
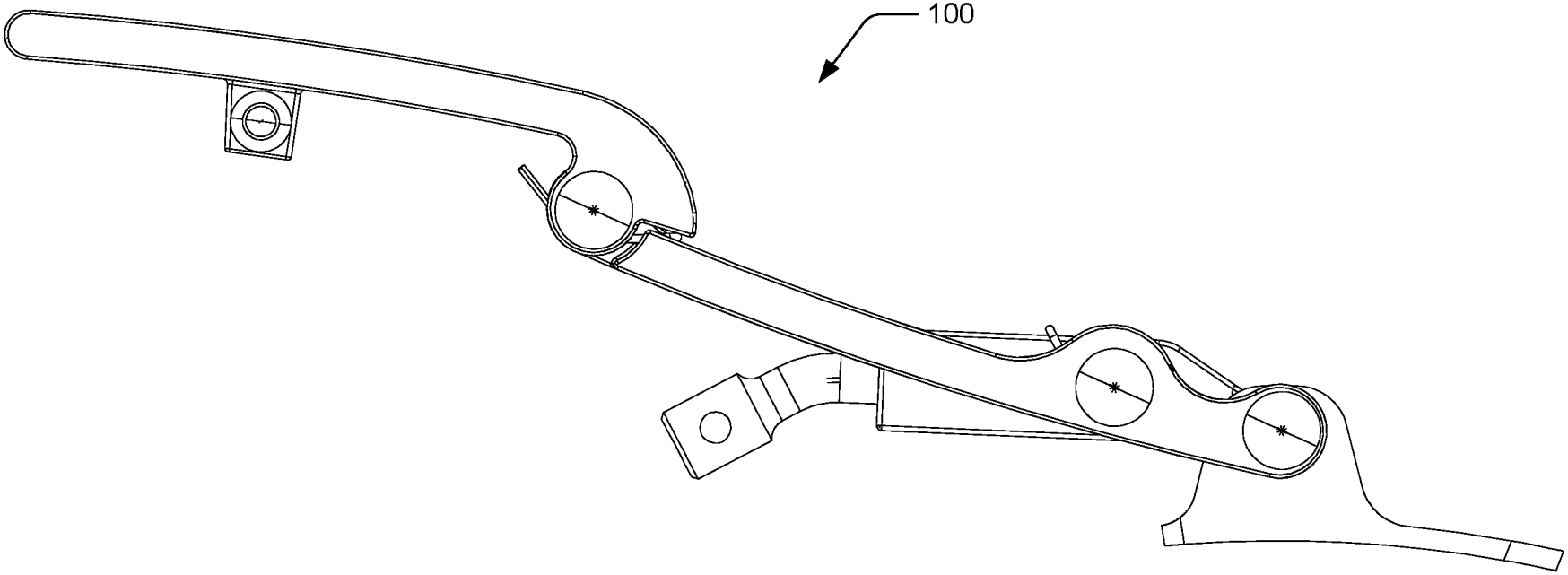
FIG. 13 illustrates a top view of the embodiment of FIG. 1 of the buckle, in the open position, according to this disclosure.
Figure 14:
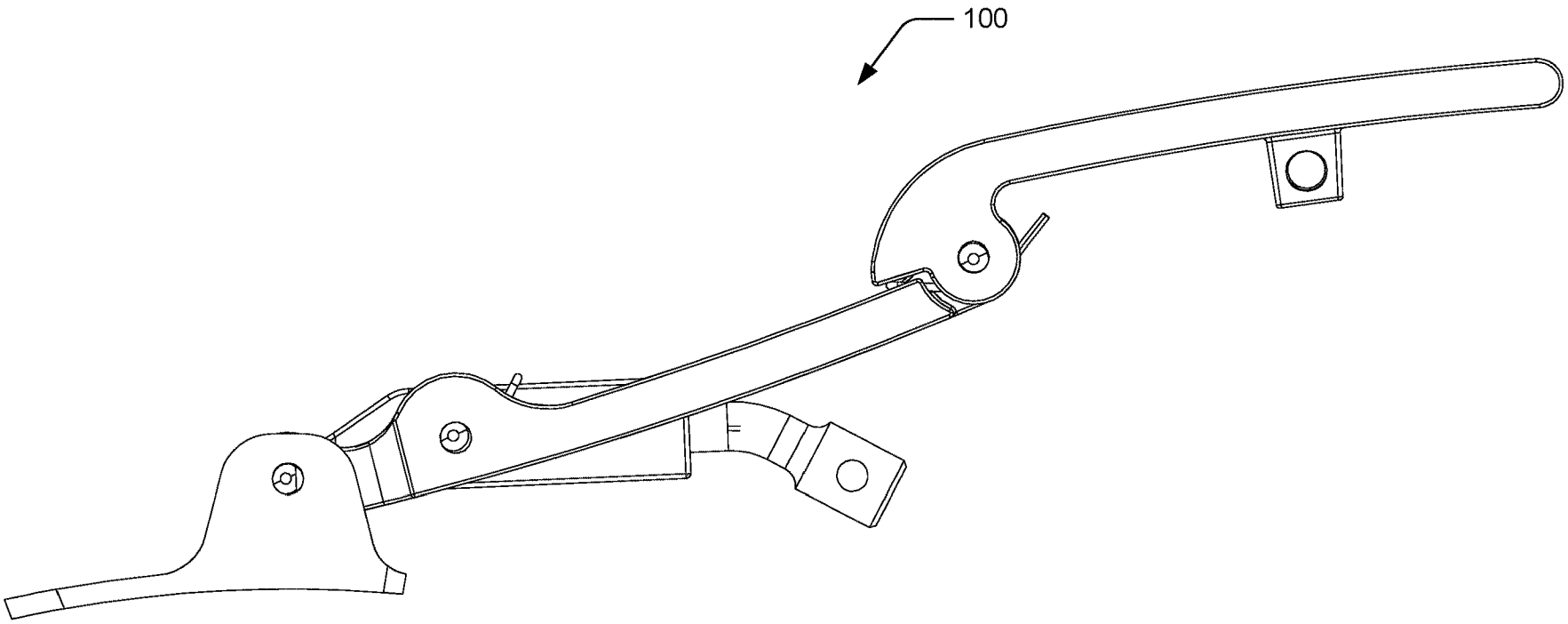
FIG. 14 illustrates a bottom view of the embodiment of FIG. 1 of the buckle, in the open position, according to this disclosure.

FIG. 6 illustrates a top view of the embodiment of FIG. 1 of the buckle, which shows a side view of the catch engagement component 136. Here, FIG. 6 depicts the closed position of the buckle 100 with the catch engagement component 136 protruding from a surface of the body 130 of the second cinch member 108.

FIGS. 7-14 illustrate various views of the embodiment of FIG. 1. The views are intentionally not discussed explicitly beyond the description above. However, FIGS. 7-14 are included herein to provide clarity to the features claimed, as/if needed.

Figure 15:
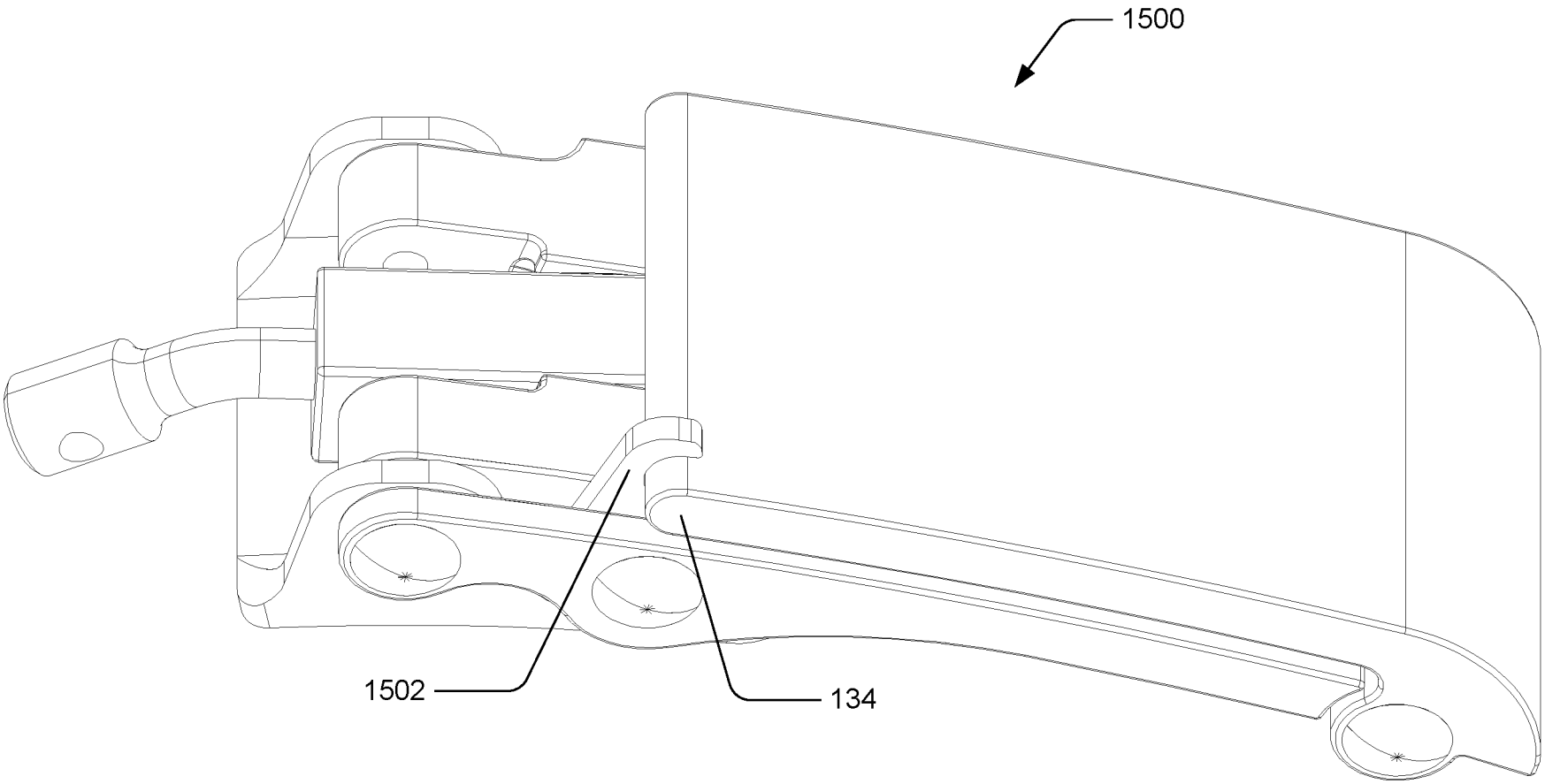
FIG. 15 illustrates a perspective view of another embodiment of a buckle, in the closed position, according to this disclosure.

While FIGS. 1-14 focus on a particular embodiment disclosed herein, FIG. 15 illustrates a perspective view of another embodiment of a buckle 1500, in the closed position, in which a hook latch 1502 is included as located and pivotably fixed to the buckle 1500 in order to clasp over an edge of the free end 134 of the second cinch member 108, when in the closed position.

Figure 16:
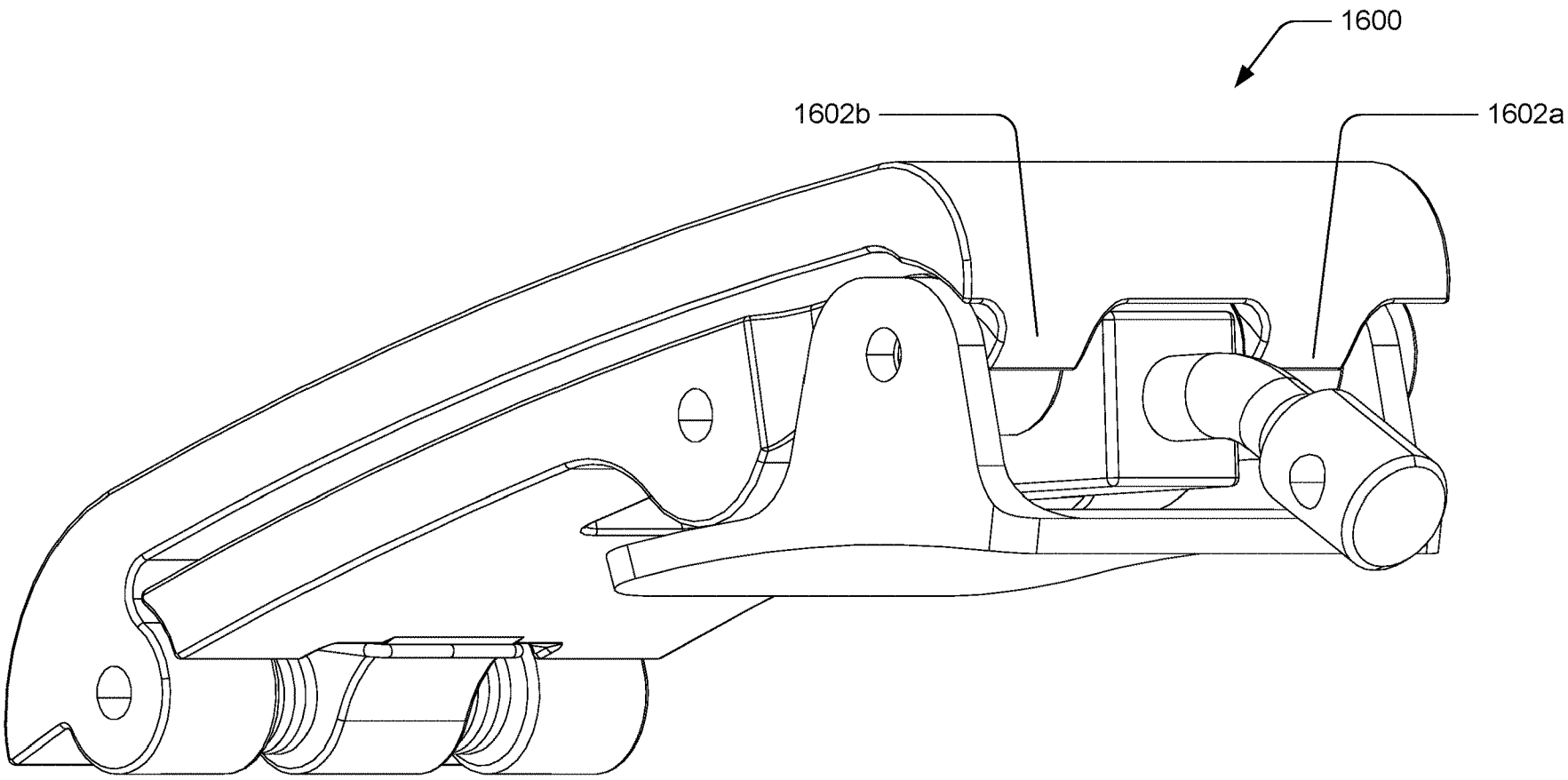
FIG. 16 illustrates a perspective view of yet another embodiment of a buckle, in the closed position, according to this disclosure.
Figure 17:
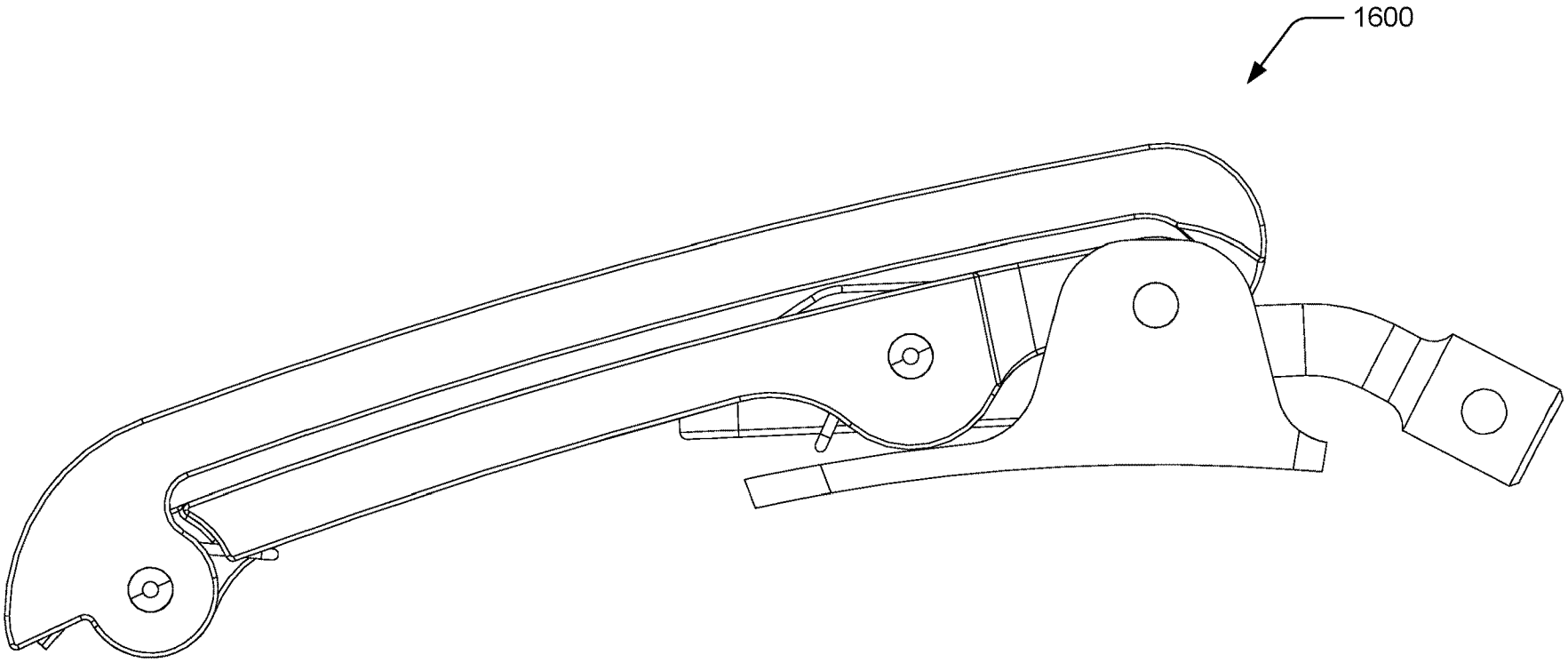
FIG. 17 illustrates a bottom view of the embodiment of FIG. 16 of the buckle, in the closed position, according to this disclosure.

Alternatively, FIGS. 16 and 17 further depict a second alternative embodiment of a buckle 1600, in which the second cinch member 108 is cinched to the first cinch member 106 via one or more compression clasps 1602*a*, 1602*b*. The compression clasp(s) 1602*a*, 1602*b* may include one or more extended hooked-shaped end(s) on the free end 134 of the body 130 of the second cinch member 108. The hooked end(s) of the compression clasp(s) 1602*a*, 1602*b* may slide over a corresponding shoulder portion at the first end of the first cinch member 106, by applying pressure to the second cinch member 108, thereby causing an elastic flex to the first cinch member 108, to rest in the closed position. Thus, the first cinch member 106 to the second cinch member 108 in a compressive state, which is overcome by a predetermined amount of pressure to open and close the buckle 100.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A buckle comprising:

a fixed base attachment member including:

a body base that has an object mounting surface, and a connection section that extends upward from the body base;

a first cinch member including:

a first end rotationally connected to the connection section of the fixed base attachment member via a first axially aligned pivot joint, and a second end including a protrusion extending therefrom, a second cinch member including:

a first end connected to the protrusion at the second end of the first cinch member, and a free end opposite the first end of the second cinch member; and an adjustable attachment member connected, at a portion between opposing ends thereof, to the first cinch member, and having an object attachment member at a first end of the opposing ends, whereby the object attachment member is configured to attach to an object on which the object mounting surface rests when implemented on the object, and wherein the adjustable attachment member is rotationally and translationally attached to the first cinch member via a second axially aligned pivot joint.

2. The buckle according to claim 1, wherein the connection section of the fixed base attachment member includes a pair of connection flanges that extend from laterally opposing edges of the body base.

3. The buckle according to claim 1, wherein the first end of the second cinch member is rotationally and translationally attached to the second end of the first cinch member via a third axially aligned pivot joint.

4. The buckle according to claim 1, wherein the first cinch member includes a catch to secure the second cinch member in a closed position.

5. The buckle according to claim 4, wherein the second cinch member includes a catch engagement component that engages with the catch of the first cinch member to be secured in the closed position.

6. A buckle comprising:

a first attachment member including a connection section;

a first cinch member joined to the first attachment member, the first cinch member including:

a body, a pair of arms that extend from a first end of the body and are pivotably connected to the connection section of the first attachment member, a protrusion that extends from a second end of the body in a direction opposite a direction of extension of the pair of arms, and an attachment member pivot joint;

a second attachment member including a connection section configured to engage the attachment member pivot joint of the first cinch member; and a second cinch member attached to the protrusion of the first cinch member.

7. The buckle according to claim 6, wherein the first cinch member includes a catch to secure the second cinch member when the buckle is in a closed position, and wherein the second cinch member includes a catch engagement component to engage the catch of the first cinch member.

8. The buckle according to claim 7, wherein the catch includes a magnetic attraction with the catch engagement component.

9. The buckle according to claim 7, wherein the catch includes a hole that extends at least partly through a thickness of the body of the first cinch member, the hole being sized to receive a protrusion of the catch engagement component, the protrusion extending from the second cinch member toward the first cinch member, and wherein the catch engagement component includes a ball or a detent to secure the second cinch member thereto.

10. The buckle according to claim 6, wherein the first cinch member is straddle mounted to the second cinch member via the protrusion of the first cinch member.

11. The buckle according to claim 6, wherein the first cinch member is straddle mounted to the first attachment member via the connection section.

12. The buckle according to claim 6, wherein the second cinch member aligns with the first cinch member in an open position.

13. A buckle comprising:

a fixed base attachment member including:

a body base that has an object mounting surface, and a connection section that extends upward from the body base;

a first cinch member including:

a first end pivotably connected to the connection section of the fixed base attachment member, a second end including a protrusion extending therefrom, and a catch to secure the buckle in a collapsed position;

a second cinch member including:

a first end pivotably connected to the protrusion at the second end of the first cinch member, a free end opposite the first end of the second cinch member, and a catch engagement component corresponding to the catch of the first cinch member; and an adjustable attachment member having a first opposing end and a second opposing end, and the adjustable attachment member being connected, at a portion between the first opposing end and the second opposing end, to the first cinch member, and having an object attachment member at the first opposing end, whereby the object attachment member is configured to attach to an object on which the object mounting surface rests when implemented on the object.

14. The buckle according to claim 13, wherein the object attachment member is connectable to the object via an axial hole therethrough at the first opposing end of the adjustable attachment member.

15. The buckle according to claim 13, wherein the second opposing end of the adjustable attachment member is rotationally and translationally pivotable about a pivot joint on the first cinch member.

16. The buckle according to claim 15, wherein the pivot joint of the first cinch member is one of three pivot joints on the first cinch member.

17. The buckle according to claim 13, wherein the body base of the fixed base attachment member conforms to a surface of the object to which the buckle is attachable.

18. The buckle according to claim 13, further comprising a biasing spring attached between the first cinch member and the second cinch member.

* * * * *